US006982679B2

(12) United States Patent
Kralovec et al.

(10) Patent No.: US 6,982,679 B2
(45) Date of Patent: Jan. 3, 2006

(54) COAXIAL HORN ANTENNA SYSTEM

(75) Inventors: Jay A. Kralovec, Melbourne, FL (US); Griffin K. Gothard, Satellite Beach, FL (US); Timothy E. Durham, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 226 days.

(21) Appl. No.: 10/694,469

(22) Filed: Oct. 27, 2003

(65) Prior Publication Data

US 2005/0088355 A1 Apr. 28, 2005

(51) Int. Cl.
*H01Q 13/00* (2006.01)

(52) U.S. Cl. ..... 343/781 CA; 343/781 P; 343/786

(58) Field of Classification Search ..... 343/772, 343/778, 781 CA, 781 P, 786, 840
See application file for complete search history.

(56) References Cited

U.S. PATENT DOCUMENTS 5,373,302 A * 12/1994 Wu ..... 343/781 P
5,907,309 A 5/1999 Anderson et al.
6,020,859 A * 2/2000 Kildal ..... 343/781 CA
6,137,449 A * 10/2000 Kildal ..... 343/781 P
6,211,834 B1 4/2001 Durham et al.
6,323,819 B1 11/2001 Ergene
6,512,485 B2 * 1/2003 Luly et al. ..... 343/781 CA
6,697,027 B2 * 2/2004 Mahon ..... 343/781 CA
2005/0099350 A1 * 5/2005 Gothard et al. ..... 343/781 CA
2005/0099351 A1 * 5/2005 Gothard et al. ..... 343/781 CA

OTHER PUBLICATIONS

Stanton, P.H., "Development of a 7.2-, 8.4-, and 32-Gigahertz (X-/X-/Ka-Band) Three-Frequency Feed for the Deep Space Network" TMO Progress Report 42-145, May 15, 2001.
Zhang, Xiaolei, "Design of Conical Corrugated Feed Horns for Wide-Band High-Frequency Applications" IEEE Transactions on Microwave Theory and Techniques, vol. 41, NO. 8, Aug. 1993.
Thomas, B. "Antenna Design Notes" IEEE Transactions on Antennas and Propagation, vol. AP-26, No. 2, Mar. 1978.

* cited by examiner

*Primary Examiner*—Shih-Chao Chen
(74) *Attorney, Agent, or Firm*—Sacco & Associates, PA

(57) ABSTRACT

An antenna feed system includes a plurality of RF horn antennas (201, 202) for operating on a plurality of RF frequency bands. A first one of the feed horns (202) can have a boresight axis and is configured for operating at a first one of the frequency bands. A second one of the feed horns (201) is positioned coaxially within the first one of the feed horns (202) and is configured for operating at least at a second one of the frequency bands. Further, the first one of the feed horns (202) is a corrugated horn that has a plurality of corrugations (204) formed on an interior surface defining a profile. The profile extends substantially from a throat (205) of the first feed horn and along a tapered portion of the first feed horn. The profile substantially minimizes an interaction of the corrugations with the second feed horn.

38 Claims, 2 Drawing Sheets

COAXIAL HORN ANTENNA SYSTEM

RESEARCH OR DEVELOPMENT

The United States Government has rights in this invention pursuant to Contract No. N00039-00-D-3210, between the United States Navy and Harris Corporation.

BACKGROUND OF THE INVENTION

1. Statement of the Technical Field

The inventive arrangements relate generally to methods and apparatus for ring focus antennas and feed systems, and more particularly to ring focus antennas and feed systems that can operate in multiple frequency bands.

2. Description of the Related Art

It is often desirable for microwave satellite communication antennas to have the ability to operate on multiple frequency bands. In those situations where a single coaxial feed for multiple bands is desired, it can be challenging to maintain existing system specifications without changing the design of the main reflector and the sub-reflector. Further, space limitations associated with existing designs can severely restrict design options.

U.S. Pat. No. 6,211,834 B1 to Durham et al. (hereinafter Durham), concerns a multi-band shaped ring focus antenna. In Durham, a pair of interchangeable, diversely shaped, close proximity-coupled sub-reflector-feed pairs are used for operation at respectively different spectral frequency bands. Swapping out the subreflector/feed pairs changes the operational band of the antenna. Advantage is gained by placement of the shaped sub-reflector in close proximity to the feed horn. This reduces the necessary diameter of the main shaped reflector relative to a conventional dual reflector antenna of the conventional Cassegrain or Gregorian variety. The foregoing arrangement of the feed horn in close proximity to the sub-reflector is referred to as a coupled configuration.

Although Durham demonstrates how a ring focus antenna may operate at different spectral bands, sub-reflector-feed pairs must be swapped each time the operational band of the antenna is to be changed. Accordingly, that system does not offer concurrent operation on spectrally offset frequency bands. U.S. Pat. No. 5,907,309 to Anderson et al. and U.S. Pat. No. 6,323,819 to Ergene each disclose dual band multimode coaxial antenna feeds that have an inner and outer coaxial waveguide sections. However, in the case of ring focus antennas, it can be desirable for the feed to have an illumination pattern that is rotationally symmetric, with substantially equal E- and H-plane beamwidths. Further, with conventional designs it can difficult to obtain the desired gain performance or illumination required to meet system specifications.

One type of horn antenna that does produce an illumination pattern that is rotationally symmetric, with substantially equal E- and H-plane beamwidths, is known as a corrugated horn antenna. A corrugated horn antenna typically includes circumferential slots, or corrugations, along the interior walls of the antenna. The depth of the corrugations is typically ¼ of a wavelength at the operating frequency, which substantially increases the surface impedance of the wall as compared to a smooth wall. The increased surface impedance results in the corrugated horn antenna having a symmetrical radiation pattern or low cross-polarization that produces nearly equal magnetic field and electric field planes. Another advantage of the corrugated horn antenna is that it typically can be operated over a larger bandwidth as compared to a horn antenna having smooth walls.

For the foregoing reasons, corrugated horns are often used as feeds for reflector antennas or as direct radiators. Still, in the case where multi-band operation of a ring focus reflector system is required, a single corrugated horn antenna has generally proved to be unsuitable. Shaping of the radiation pattern of a corrugated horn is commonly achieved by controlling the length of the horn and/or by shaping the profile of the horn. Where the length of the horn is restricted due to space limitations, shaping of the profile is a key factor for producing a desired radiation pattern.

The profile of a corrugated horn can be optimized either by using existing data concerning the effect of conventional profiles or by creating hybrid profiles that combine one or more conventional profiles. Further optimization of corrugated horn antennas can be achieved by selectively controlling the profile and/or slot depth of each corrugation. Despite the availability of such techniques, it is not always possible to optimize a single corrugated horn antenna to produce a suitable illumination pattern at widely separated frequencies of interest. Coaxial horns, such as those disclosed in U.S. Pat. No. 5,907,309 to Anderson et al. and U.S. Pat. No. 6,323,819 to Ergene can be used to create a common feed for widely separated frequencies of interest, but do not offer the benefits provided by corrugated horn antennas.

SUMMARY OF THE INVENTION

The invention concerns an antenna feed system. The feed system can include a plurality of RF horn antennas for operating on a plurality of RF frequency bands. A first one of the feed horns can have a boresight axis and is configured for operating at a first one of the frequency bands. A second one of the feed horns is positioned coaxially within the first one of the feed horns and is configured for operating at least at a second one of the frequency bands. Further, the first one of the feed horns is a corrugated horn that has a plurality of corrugations formed on an interior surface defining a profile. The profile extends substantially from a throat of the first feed horn and along a tapered portion of the first feed horn. The profile substantially minimizes an interaction of the corrugations with the second feed horn.

According to one aspect, the profile is defined by the expression $$r(z) = r_t + (r_a - r_t) * \left\{ (1 - A)\frac{z}{L} + A\sin^2\left(\frac{z\pi}{2L}\right) \right\}$$

where A is a constant that has a value of between about 0.4 and 0.6, $r_a$ is the radius of the aperture of the first horn, $r_t$ is the radius of the throat of the first horn, L is the overall length of the first horn, and z is the position relative to the throat of the first horn. The corrugations can extend substantially continuously along the throat and the tapered portion of the first one of the feed horns.

Further, a slot depth of the corrugations can advantageously selected to improve the performance of the coaxial antenna feed system. For example, the slots can define a matching section in the throat portion of the horn. The slots in this matching section can have a depth that tapers exponentially from about ½ wavelength at the portion of the matching section nearest the waveguide feed, to about ¼ wavelength at the portion of the matching section that is nearest the aperture. A remainder of the slots can have a depth of less than ¼ wavelength at a lowest operating frequency of the first feed horn.

According to another aspect of the invention, an RF choke can be disposed on an exterior surface of the second feed horn adjacent to an aperture of the second feed horn. Further, a plurality of phase compensating corrugations can be provided exclusive of the corrugations defining the profile. The phase compensating corrugations can be provided at an aperture of the first horn and define a linear profile section parallel to a boresight axis of the antenna system for the purpose of aligning the phase centers of the first and second horns.

The invention can also include a multi-band ring focus antenna system. The antenna system can include a main reflector having a shaped surface of revolution about a boresight axis of the antenna and being operable at a plurality of frequency bands spectrally offset from each other. A multi-band feed system for the main reflector can be provided. The feed system can comprise a sub-reflector defining a second shaped surface of revolution about the boresight axis of the antenna and a plurality of feed horns decoupled from the sub-reflector.

A first one of the feed horns can be installed on the boresight axis at a first location separated by a first gap from a vertex of the sub-reflector. The first feed horn can have a plurality of corrugations defining a profile extending from a throat of the first feed horn and along a tapered portion of the first feed horn. The profile produces a radiation pattern for illuminating the sub-reflector so as to define a ring-shaped focal point about the boresight axis for illuminating the main reflector at a first one of the frequency bands.

A second one of the feed horns can be installed coaxial within the first one of the feed horns and separated from the vertex on the boresight axis by a second gap. The second feed horn is shaped to produce a radiation pattern illuminating the sub-reflector so as to define a second ring-shaped focal point about the boresight axis for illuminating the main reflector on at least a second one of the frequency bands.

DETAILED DESCRIPTION OF THE PREFERRED EMBODIMENTS

Figure 1:
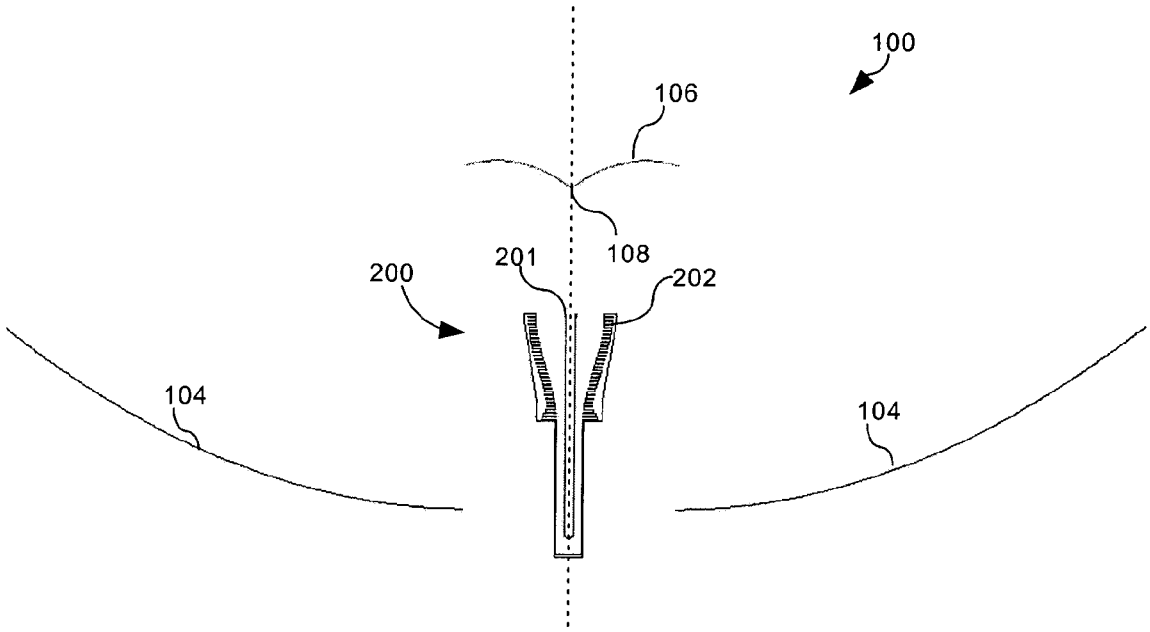
FIG. 1 is a schematic representation of a dual band ring focus antenna that is useful for understanding the present invention.

Referring to FIG. 1, a main reflector 104 and sub-reflector 106 are shown for a ring-focus, dual band antenna system 100. Ring-focus antenna systems are well known in the art. Such antennas are advantageous, as they are compact designs that offer acceptable performance for many communications applications. Main reflector 104 and sub-reflector 106 are typically shaped surfaces of revolution disposed about a boresight axis. Further, the main reflector 104 and the sub-reflector 106 can be designed for multi-band operation. For example, the main reflector and the sub-reflector can be designed to operate concurrently at X-band, K-band and Ka-band.

In a conventional ring-focus antenna systems, interchangeable microwave feed horn antennas can be swapped out for operating on different frequency bands. For example, one horn can be designed for operation on X-band whereas a second horn can be designed for operation on K-band. By swapping out different horns, the antenna system can be manually reconfigured to operate on two or more spectrally offset frequency bands. However, according to a preferred embodiment shown in FIG. 1, it can be advantageous to combine the functions of a plurality of interchangeable horns into a single coaxial feed 200 capable of operating concurrently on two or more spectrally offset RF frequency bands into a single unit. The coaxial feed 200 can be comprised of an inner horn 201 for operating on a first band of frequencies and an outer horn 202 for operating on a relatively lower second band of frequencies. For example, the outer horn 202 can be used for X-band whereas the inner horn can be used for operating on K- and Ka-band. With the foregoing arrangement, the main reflector 104 and sub-reflector 106 can also be used concurrently on the two or more spectrally offset frequency bands.

According to one embodiment of the invention, the coaxial feed 200 can be de-coupled from the sub-reflector. As used herein, the term "de-coupled" refers to RF feed horns that are positioned so that an aperture of the feed horn is positioned at least about four wavelengths from a vertex 108 of the sub-reflector 106 at an operating frequency for the feed unit. In a de-coupled arrangement, a feed horn performance and operation is not directly affected by the sub-reflector. In a de-coupled arrangement, the sub-reflector behaves more like an optical reflector element. By comparison, in a coupled arrangement, there is a direct electromagnetic interaction of the feed-horn and the sub-reflector in a way that actually affects the operating behavior of the feed horn. Still, those skilled in the art will appreciate that the invention described herein is not limited to any particular antenna feed position or arrangement.

One important design consideration for an antenna feed can be the degree of E- and H-plane match achieved at the phase center of the antenna. A high degree of matching results in low cross-polarization, a feature that is important for circularly polarized antenna systems. Still, many microwave horn antennas do not provide a sufficiently high degree of E- and H-plane match for certain applications. This problem can be compounded in the case of a coaxial horn assembly, where E- and H-plane matching can become even further distorted for the outer coaxial horn .

Figure 2:
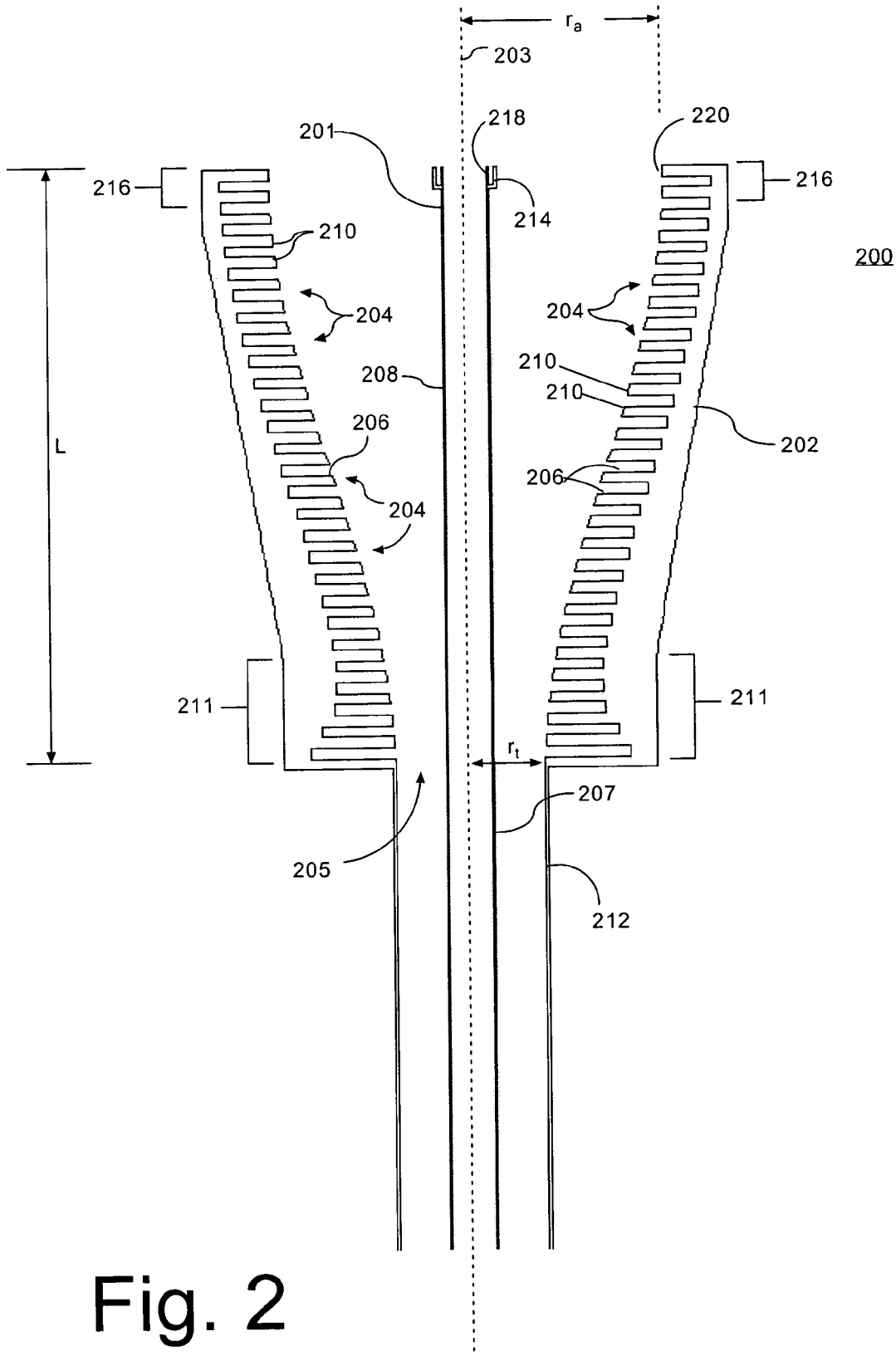
FIG. 2 is a cross-sectional view of a coaxial horn antenna feed system for the dual-band ring focus antenna of FIG. 1.

In order to overcome these deficiencies of the prior art, at least the outer horn 202 of coaxial feed 200 can be formed as a corrugated horn antenna. Corrugated horns are well known in the art. In general, corrugated horns have a series of corrugations 204 defined by slots 206 formed in the walls of the horn as illustrated in FIG. 2. To form an effective corrugated surface, ten or more slots per wavelength are usually required. Corrugated horns can have various different cross-sections. For example, they may be pyramidal or conical. For the purposes of a ring focus reflector antenna feed, the outer horn 202 and the inner horn 201 preferably have a circular cross-section so that they are radially symmetric about a boresight axis. In any case, corrugated horn antennas are advantageous as they can produce an almost rotationally symmetric pattern with equal E- and H-plane beamwidths.

Although corrugated horns can offer certain advantages, there is an inherent problem in combining this type of horn with a second horn in a coaxial arrangement. In particular, corrugations 204 formed on an outer horn 202 will inherently tend to interact with the outer surface 208 of the inner horn 201. In particular, it has been found that where a smaller diameter horn for a higher frequency is positioned coaxially within a larger diameter corrugated horn for a lower frequency, interference is likely to occur. For example, the higher frequency horn can interfere with the operation of the corrugations and the corrugations can interfere with the operation of the higher frequency horn. Accordingly, the structure of a coaxial feed that includes a corrugated antenna must be designed to minimize adverse effects of such interaction.

According to a preferred embodiment, a profile of the interior surface of horn 202 as defined by the inner faces 210 of corrugations 204 can be formed so as to minimize interactions between the corrugations and the outer surface 208 of the inner horn. In particular, a shape for the profile is preferably selected to move the corrugations away from the center waveguide quickly, but not so quickly as to excite any unwanted modes. This shape can be continuous or piecewise linear, i.e. depending on the number of Z points one uses to define the surface, the shape may not be smooth but can instead be comprised of a plurality of linear segments. The shaping equation is as follows:

$$r(z) = r_t + (r_a - r_t) * \left\{ (1 - A)\frac{z}{L} + A\sin^2\left(\frac{z\pi}{2L}\right) \right\}$$

where:

A is a constant;

$r_a$ is the radius of the aperture of the horn;

$r_t$ is the radius of the throat of the horn;

L is the overall length of the horn; and z is the position relative to the throat of the horn, i.e., z=0 at the throat.

The foregoing equation is known for the purposes of shaping a radiation pattern for a corrugated horn. For example, it is reproduced as equation 9.58 in a text entitled "Microwave Horns and Feeds" by Olver, Clarricoats, Kishk and Shafai. Still, it has been generally accepted in the prior art that the value of the constant "A" in the shaping equation should be between about 0.7 to 0.9 in order to achieve satisfactory results. Larger values of A give greater curvature whereas smaller values of A produce a more linear taper. However, when used in the context of a coaxial horn arrangement, the resulting horn using a value for the constant A in the range of 0.7 to 0.9 has been found to produce unusable results. For example, pattern distortions, high return loss, and poor E and H plane matching become serious problems. In contrast, it has been found that by selecting the constant A to have a value in the range of between about 0.4 to 0.6, the foregoing shaping equation can be used to advantageously minimize interactions between corrugations 204 of an outer horn 202 and the outer surface 208 of inner horn 201.

The diameter of the inner waveguide 207 is selected such that the lowest frequency of interest for the waveguide is supported. For example, if the inner horn 201 is intended to operate within K-band (18–27 GHz) and Ka band (27–40 GHz), then the inner waveguide must have a diameter that is sufficiently large to support the lowest K-band operating frequency. The outer waveguide 212 must similarly have a diameter that will support the lowest frequency of interest.

The outer horn aperture diameter was found by determining the desired sub-reflector edge illumination. This information was used to match a specific horn aperture pattern to the illumination level at the correct subtended angle of the sub-reflector. The inner horn diameter is limited by largest diameter allowable by the outside horn.

The depth of the slots 206 can also have a significant effect on the operation of the outer horn. Conventional corrugated horns typically have slots that are about ¼ wavelength deep However, in the case of a coaxial arrangement of the horns, the depth of the slots requires special attention. A section of the horn extending about 1 to 2 wavelengths from the throat 205 can be formed as a matching section 211. The matching section can include slots 206 that have a depth that is substantially greater than ¼ wavelength. The wavelength referred to in this regard is generally the wavelength of the lowest frequency of operation for the outer horn 202. In the embodiment shown in FIG. 2, the matching section can be comprised of between about 4 to 6 corrugations. However, the invention is not limited to any particular number of corrugations in this regard, and the matching section can comprise a somewhat larger or smaller number of corrugations depending upon the spacing and size of the corrugations selected. The size and spacing of the corrugations can be selected by the designer to be suitable for the application.

According to a preferred embodiment, the matching section 211 should be designed so as to achieve the best possible match between the smooth walled outer waveguide 212 and the outer horn 202, with the inner horn 201 present. In order to achieve this result, it has been found that the slots 206 can have a depth that tapers exponentially from about ½ wavelength at the portion of the throat 205 nearest the smooth walled outer waveguide 212, to about ¼ wavelength at the portion of the choke matching section 211 that is furthest from the smooth walled waveguide. The wavelength referred to in this instance is the lowest frequency at which the outer horn 202 is designed to operate.

The remainder of the slots 206 exclusive of the matching section 211 can be adjusted in depth so as to give the best overall E- and H-plane pattern match for all of the bands on which the coaxial feed 200 is intended to operate. In this regard it should be noted that the corrugation depths will affect the performance of the inner horn 201 in addition to the outer horn 202. Thus, the depth of the slots must be duly considered at each band of interest. For example, if the inner horn 201 is designed for operation at K-band and Ka-band, and the outer horn 202 is designed for operation at X-band, then the corrugation depths should be adjusted to achieve the best overall E- and H-plane pattern on all bands.

As a starting point, the slots 206 can be chosen to be ¼ wavelength in depth at the lowest band of interest. Thereafter, computer modeling can be used to determine an optimum depth for the particular bands on which the outer horn is intended to operate. For example, where the lower band is X-band and the highest band is Ka-band, it has been found that optimal depths for the slots 206 are 1/3.6, 1/3.3 wavelengths respectively for the lowest X-band receive and transmit frequencies, and 1/1.27, 1/0.87 wavelengths at the lowest receive and transmit frequencies, respectively, for Ka-band. However, other band combinations and frequencies are also possible and the invention is not limited to these particular values. Instead, computer modeling should be used to optimize the depth selected for the slots at less than ¼ wavelength for the particular bands and frequencies of interest.

A further improvement in performance of the inner horn 201 can be achieved by the addition of a choke 214 that extends radially around the aperture of the inner horn. The choke 214 advantageously reduces currents on the outer surface 208 of horn 201. The reduction in currents improves pattern performance and, in general, the interaction with the outer horn.

According to one embodiment, one or more corrugations 204 can define a linear section 216 adjacent to the aperture 220 of outer horn 202. The linear section can be appended to the profiled portion of the outer horn 202 defined by the shaping equation. The inner faces 210 of the corrugations in the linear section 216 are preferably arranged to define a linear surface parallel to the boresight axis 203. The purpose of the linear section is to move the phase center of the outer horn 202 further toward the aperture 220 of the outer horn. Consequently the phase center of the outer horn 202 can more closely coincide with the phase center of the inner horn 201. Inner horn 201 in this instance is essentially an open ended waveguide and consequently the phase center for the inner horn will be typically close to the aperture.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims.

We claim:

1. A multi-band antenna system comprising:

a main reflector having a shaped surface of revolution about a boresight axis of said antenna system and being operable at a plurality of frequency bands spectrally offset from each other;

a multi-band feed system for said main reflector comprising a sub-reflector defining a second shaped surface of revolution about said boresight axis of said antenna and a plurality of feed horns decoupled from said sub-reflector;

a first one of said horns installed on said boresight axis at a first location separated by a first gap from a vertex of said sub-reflector, said first horn having a plurality of corrugations defining a profile extending from a throat of said first horn and along a tapered portion of said first horn, said profile shaped for producing a radiation pattern for illuminating said sub-reflector at a first frequency band; and a second one of said horns installed coaxial within said first one of said horns and separated from said vertex on said boresight axis by a second gap, said second horn configured for producing a radiation pattern illuminating said sub-reflector on a second frequency band spectrally offset from said first frequency band.

2. The multi-band antenna system according to claim 1 wherein said profile is defined by the expression $$r(z) = r_t + (r_a - r_t) * \left\{ (1 - A)\frac{z}{L} + A\sin^2\left(\frac{z\pi}{2L}\right) \right\}$$

where A is a constant that has a value of between about 0.4 and 0.6, $r_a$ is the radius of the aperture of the first horn, $r_t$ is the radius of the throat of the first horn, L is the overall length of the first horn, and z is the position relative to the throat of the first horn.

3. The multi-band antenna system according to claim 1 wherein said corrugations are disposed continuously along said throat and said tapered portion of said first horn.

4. The multi-band antenna system according to claim 1 further comprising an RF choke disposed on an exterior surface of said second feed horn at an aperture end thereof.

5. The multi-band antenna system according to claim 1 further comprising one or more phase compensating corrugations exclusive of said corrugations defining said profile, said phase compensating corrugations provided at an aperture of said first horn and defining a linear profile section parallel to a boresight axis of said antenna system.

6. The multi-band antenna system according to claim 5 wherein said phase compensating corrugations reposition a phase center of said first horn to substantially coincide with a phase center of said second horn.

7. The multi-band antenna system according to claim 1 further comprising a matching section formed from a plurality of said corrugations in the throat portion of said first horn.

8. The multi-band horn antenna system according to claim 7 wherein said corrugations of said matching section are comprised of a plurality of adjacent slots having differing depths, said depths tapering exponentially from a slot nearest a waveguide feed for said first horn to a slot at the portion of the matching section that is nearest an aperture of said first horn.

9. The multi-band horn antenna system according to claim 8 wherein said depths taper from about ½ wavelength for said slot at the portion of the throat nearest the waveguide feed, to about ¼ wavelength for said slot at the portion of the matching section that is nearest the aperture.

10. The multi-band antenna system according to claim 7 wherein a slot depth of said corrugations, exclusive of said corrugations forming said matching section, is less than ¼ wavelength at a lowest operating frequency of said first horn.

11. The multi-band antenna system according to claim 1 wherein said second horn is an open-ended waveguide, exclusive of any taper along a length of said horn.

12. The multi-band antenna system according to claim 1 wherein a first distance between said vertex and an aperture of said first horn, as measured along said boresight axis, is substantially equal to a second distance between said vertex and an aperture of said second horn measured along said boresight axis.

13. The multi-band antenna system according to claim 1 wherein said first and second distances are each more than about four wavelengths at a lowest operating frequency of said first one of said frequency bands.

14. An antenna feed system, comprising:

a plurality of feedhorns for operating on a plurality of RF frequency bands;

a first one of said horns having a boresight axis and configured for operating at a first one of said frequency bands;

a second one of said horns positioned coaxially within said first horn, said second horn configured for operating at least at a second one of said frequency bands;

wherein said first horn is a corrugated horn having a plurality of corrugations formed on an interior surface, said corrugations defining a profile extending substantially from a throat of said first feed horn and along a tapered portion of said first feed horn.

15. The antenna feed system according to claim 14 wherein said profile has a curvature that substantially minimizes an interaction of said corrugations with said second horn.

16. The antenna feed system according to claim 14 wherein said profile is defined by the expression $$r(z) = r_t + (r_a - r_t) * \left\{ (1 - A)\frac{z}{L} + A\sin^2\left(\frac{z\pi}{2L}\right) \right\}$$

where A is a constant that has a value of between about 0.4 and 0.6, $r_a$ is the radius of the aperture of the first horn, $r_t$ is the radius of the throat of the first horn, L is the overall length of the first horn, and z is the position relative to the throat of the first horn.

17. The antenna feed system according to claim 14 wherein said corrugations extend continuously along said throat and said tapered portion of said first horn.

18. The antenna feed system according to claim 14 further comprising an RF choke disposed on an exterior surface of said second horn adjacent to an aperture of said second horn.

19. The antenna feed system according to claim 14 further comprising at least one phase compensating corrugation exclusive of said corrugations defining said profile, said phase compensating corrugation provided adjacent an aperture of said first horn and defining a linear profile section parallel to a boresight axis of said antenna system.

20. The multi-band antenna system according to claim 19 wherein said phase compensating corrugation control of a position of a phase center of said first horn to substantially coincide with a position of a phase center of said second horn.

21. The multi-band antenna system according to claim 14 further comprising a matching section formed from a plurality of said corrugations in the throat portion of said first horn.

22. The multi-band horn antenna system according to claim 21 wherein said corrugations of said matching section are comprised of a plurality of adjacent annular slots having differing depths, said depths tapering exponentially from a slot nearest a waveguide feed for said first horn to a slot at the portion of the matching section that is nearest an aperture of said first horn.

23. The multi-band horn antenna system according to claim 22 wherein said depths taper from about ½ wavelength for said slot at the portion of the throat nearest the waveguide feed, to about ¼ wavelength for said slot at the portion of the matching section that is nearest the aperture.

24. The multi-band antenna system according to claim 21 wherein a slot depth of said corrugations, exclusive of said corrugations forming said matching section, is less than ¼ wavelength at a lowest operating frequency of said first horn.

25. The multi-band antenna system according to claim 14 wherein said second horn is an open-ended waveguide, exclusive of any taper along a length of said horn.

26. The antenna feed system according to claim 14 wherein an aperture of said second one of said feed horns is substantially aligned with an aperture of said first one of said feed horns.

27. An antenna feed system, comprising:

a plurality of feedhorns for operating on a plurality of RF frequency bands;

a first one of said horns having a boresight axis and configured for operating at a first one of said frequency bands;

a second one of said horns positioned coaxially within said first one of said horns along said boresight axis, said second horn configured for operating at least at a second one of said frequency bands;

wherein said first horn is a corrugated horn that has a plurality of corrugations formed on an interior surface, said corrugations extending substantially continuously along a throat portion of said first horn and a tapered portion of said first horn to define a profile, said profile substantially minimizing an interaction of said corrugations with said second horn.

28. The multi-band antenna system according to claim 27 further comprising a matching section formed from a plurality of said corrugations in the throat portion of said first horn.

29. The multi-band horn antenna system according to claim 28 wherein said corrugations of said matching section are comprised of a plurality of adjacent annular slots having differing depths, said depths tapering exponentially from a slot of said matching section nearest a waveguide feed for said first horn to a slot at the portion of the matching section that is nearest an aperture of said first horn.

30. The multi-band horn antenna system according to claim 29 wherein said depths taper from about ½ wavelength for said slot at the portion of the throat nearest the waveguide feed, to about ¼ wavelength for said slot at the portion of the matching section that is nearest the aperture.

31. The multi-band antenna system according to claim 28 wherein a slot depth of said corrugations, exclusive of said corrugations forming said matching section, is less than ¼ wavelength at a lowest operating frequency of said first horn.

32. The multi-band antenna system according to claim 31 wherein said second horn is an open-ended waveguide, exclusive of any taper along a length of said horn.

33. The antenna feed system according to claim 31 further comprising an RF choke disposed on an exterior surface of said second feed horn adjacent to an aperture of said second horn.

34. The antenna feed system according to claim 31 wherein an aperture of said second one of said horns is substantially aligned with an aperture of said first one of said feed horns.

35. The antenna feed system according to claim 31 further comprising a plurality of phase compensating corrugations exclusive of said corrugations defining said profile, said phase compensating corrugations provided at said aperture of said first horn and defining a linear profile section parallel to said boresight axis.

36. The antenna feed system according to claim 31 further comprising a sub-reflector defining a shaped surface of revolution about said boresight axis and spaced from said aperture of said first horn and said aperture of said second horn by a first and second distance, respectively, so that said sub-reflector is substantially de-coupled from each of said first horn and said second horn.

37. The antenna feed system according to claim 36 wherein said first and second distance are substantially equal.

38. The antenna feed system according to claim 31 wherein said profile is defined by the expression $$r(z) = r_t + (r_a - r_t) * \left\{ (1 - A)\frac{z}{L} + A\sin^2\left(\frac{z\pi}{2L}\right) \right\}$$

where A is a constant that has a value of between about 0.4 and 0.6, $r_a$ is the radius of the aperture of the first horn, $r_t$ is the radius of the throat of the first horn, L is the overall length of the first horn, and z is the position relative to the throat of the first horn.

* * * * *